US005593048A

United States Patent [19]

Johnson

[11] Patent Number: 5,593,048

[45] Date of Patent: Jan. 14, 1997

[54] PRODUCT DISPENSING UNIT

[75] Inventor: Allen E. Johnson, Hartford, Wis.

[73] Assignee: DCI Marketing, Milwaukee, Wis.

[21] Appl. No.: 405,592

[22] Filed: Mar. 17, 1995

[51] Int. Cl.[6] ..... A47F 5/00

[52] U.S. Cl. ..... 211/59.2; 211/184; 312/42; 312/322

[58] Field of Search ..... 211/59.2, 59.3, 211/184, 189, 186; 312/42, 322, 139.1

[56] References Cited

U.S. PATENT DOCUMENTS

| | | | |
|---|---|---|---|
| 2,669,361 | 2/1954 | Just | 211/59.2 |
| 2,730,825 | 1/1956 | Wilds | 211/59.2 X |
| 2,936,206 | 5/1960 | Wilmer et al. | 312/322 |
| 4,067,631 | 1/1978 | Kelley | 312/322 |
| 4,294,363 | 10/1981 | Oztekin et al. | 211/59.2 |
| 4,685,574 | 8/1987 | Young et al. | 211/184 X |
| 4,945,972 | 8/1990 | Takeuchi | 312/322 X |
| 5,295,591 | 3/1994 | Slater | 211/59.2 |

OTHER PUBLICATIONS

Four drawings and one page of four copies of photographs of a battery rack offered for sale in 1992 by DCI Marketing.

*Primary Examiner*—Robert W. Gibson, Jr.
*Attorney, Agent, or Firm*—Michael, Best & Friedrich

[57] ABSTRACT

A product dispensing unit such that consumers have access to products at the front of the dispensing unit, after a product is removed, another product slides in the dispensing unit via gravity to replace the product just removed, and such that the dispensing unit is adaptable to accommodate various numbers, kinds and sizes of products and access to the back of the dispensing unit is provided via a movable rear wall.

15 Claims, 3 Drawing Sheets

PRODUCT DISPENSING UNIT

FIELD OF THE INVENTION

This invention relates to product dispensing systems. More particularly, this invention relates to such systems as displays products in a manner such that the product is readily viewable and accessible to the consumer.

BACKGROUND OF THE INVENTION

Relatively large, bulky and/or heavy products pose a particular set of problems from the standpoint of achieving proper display of such products in a manner rendering the product readily accessible to the consumer, and such that the supply of the products in the display can be effectively replenished. For example, the point-of-sale arrangement of automotive batteries is typical of these problems. As sales are made, the remaining batteries should be readily accessible to the consumer from the display. In addition, replenishing the supply of batteries should not only be relatively simple but also achieved in a manner that insures that the batteries that have been on display for the longest period of time are the products accessible for the next sale. That is, the batteries are sold on a first in, first out basis.

SUMMARY OF THE INVENTION

This invention addresses those problems and has among its objects to provide a product display storage and point-of-sale unit that achieves the above stated advantageous features.

The invention provides a product dispensing unit including a housing, shelves, a rear wall and a hinge and pivot mechanism. The housing has an open front and an open back. The shelves are vertically spaced in the housing, are exposed at the open front and extend rearwardly whereby products supported on the shelves are accessible through the open front. Each of the shelves includes front and back track supports and a varying number of elongated tracks extending between the track supports. The tracks are generally U-shaped in cross-section and are arranged in pairs in the housing such that each product is supported by a pair of tracks. The tracks are inclined downwardly from the open back to the open front so that products slide along the pair of tracks-via gravity toward the open front of the housing. Each track is secured to the front and back track supports in the desired location.

The dispensing unit also includes a rear wall spaced from and generally coextensive with the housing. The dispensing unit further includes a hinge and pivot mechanism for moving the rear wall both toward and away from the open back of the housing and pivotally toward and away from the housing.

Other features and advantages of the invention will become apparent to those of ordinary skill in the art upon review of the following drawings, detailed description and claims.

Figure 1:
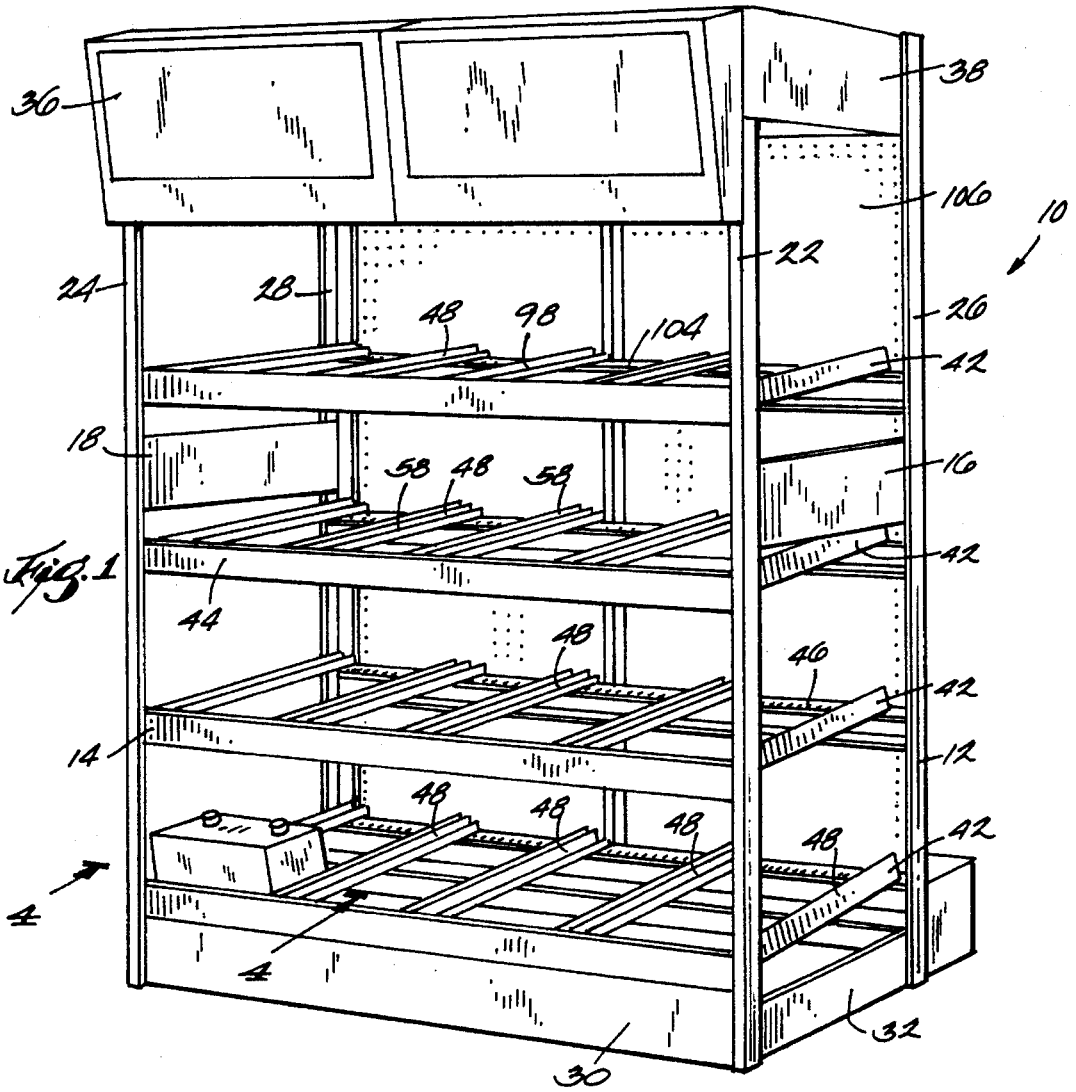
FIG. 1 is a perspective view of a product dispensing unit embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings in which like reference numerals refer to like parts throughout the views, there is shown in FIG. 1 a dispensing unit 10 embodying the invention. The dispensing unit 10 is designed such that consumers and the like have access to products at the front of the dispensing unit. After a product is removed, another product slides forward within the dispensing unit via gravity to replace the product just removed.

Figure 5:
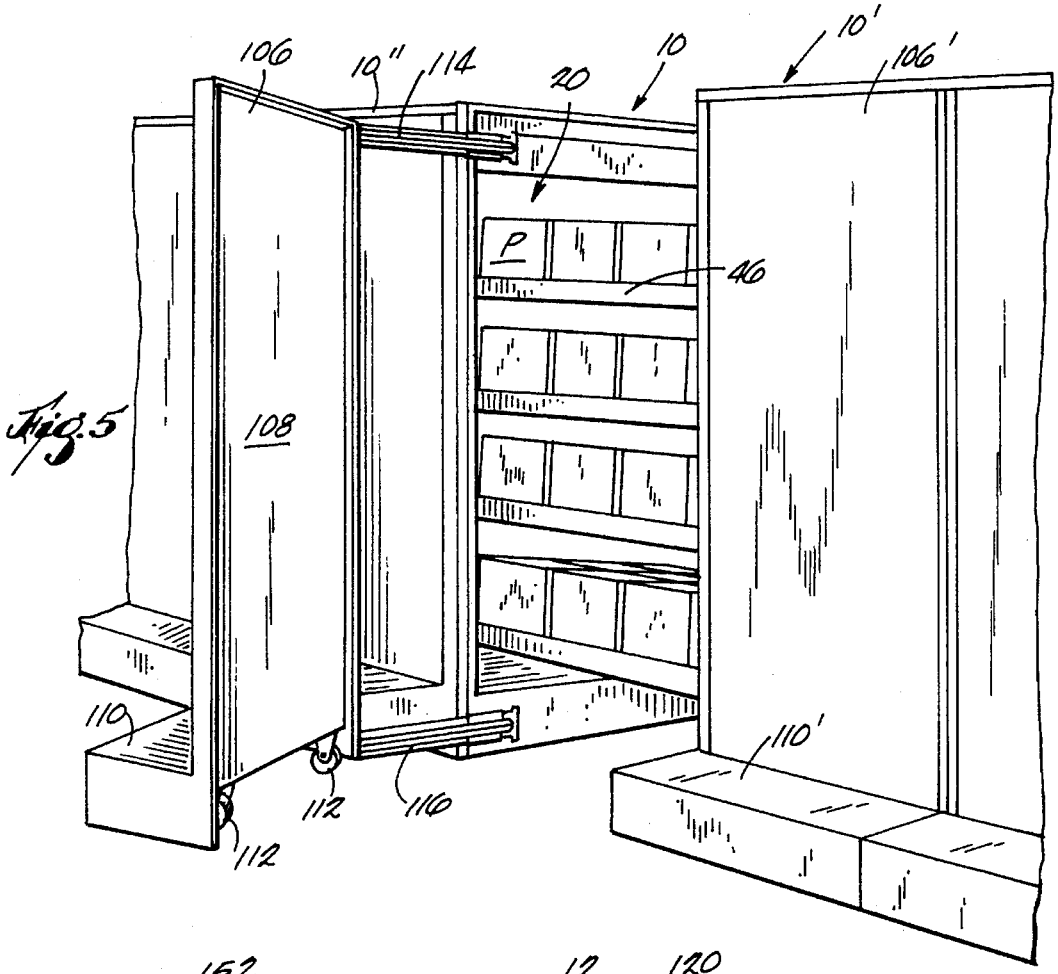
FIG. 5 is a perspective view of a plurality of product dispensing units, one such product dispensing unit having its rear wall in an open position.

More particularly, the dispensing unit 10 includes a housing 12 of a generally open construction. That is, the front 14 of the housing is open as are the sides 16 and 18. The sides 16 and 18 can be open or closed depending upon the installation. For example, if more than one dispensing unit will be standing side by side, then the interior sides can be open. If a single dispensing unit is freestanding, the otherwise exposed sides may be closed by a suitable panel (not shown). The back 20 of the housing 12 is also open (FIG. 5).

Continuing to refer to FIG. 1, the housing 12 consists of two front vertical members 22 and 24 and two rear vertical members 26 and 28. A kick plate 30 connects the lower ends of the two front vertical members 22 and 24. Similarly, the lower ends of the front vertical member 22 and rear vertical member 26 are connected via kick plate 32 and the lower ends of front vertical member 24 and rear vertical member 28 are connected via kick plate (not shown). The kick plates protect the feet of the consumer from going under the housing 12. The housing 12 also includes a front header 36 which connects the upper ends of the two front vertical members 22 and 24. The front header 36 can be used for indicia such as product information or advertising. A side header 38 connects the upper ends of front vertical member 22 and rear vertical member 26 and a side header (not shown) connects the upper ends of front vertical member 24 and rear vertical member 28.

The housing 12 also includes four vertically spaced shelves 42 that are exposed at the open front 14 so that products supported by shelves 42 are readily accessible to the consumer. It should be noted that the dispensing unit 10 is illustrated in the drawings as having four shelves 42. However, the dispensing unit 10 can be adapted to include any number of shelves. Preferably, the shelves 42 are of generally open construction and are referred to as shelves 42 in spite of the open construction because, as will be detailed below, the shelves provide support for the products to be dispensed.

Each shelf 42 is formed by a front track support 44 and a rear track support 46. To enable products to be dispensed from these generally open shelves 42, a plurality of adjustable elongated tracks 48 are utilized that extend rearwardly from the front track support 44 to the rear track support 46. A pair of such tracks 48 is utilized for each row of product to be dispensed. Each shelf 42 may selectively adapted to dispense varying sizes and numbers of products by modifying the number of tracks 48 and the distance between those tracks on the shelves 42.

Figure 2:
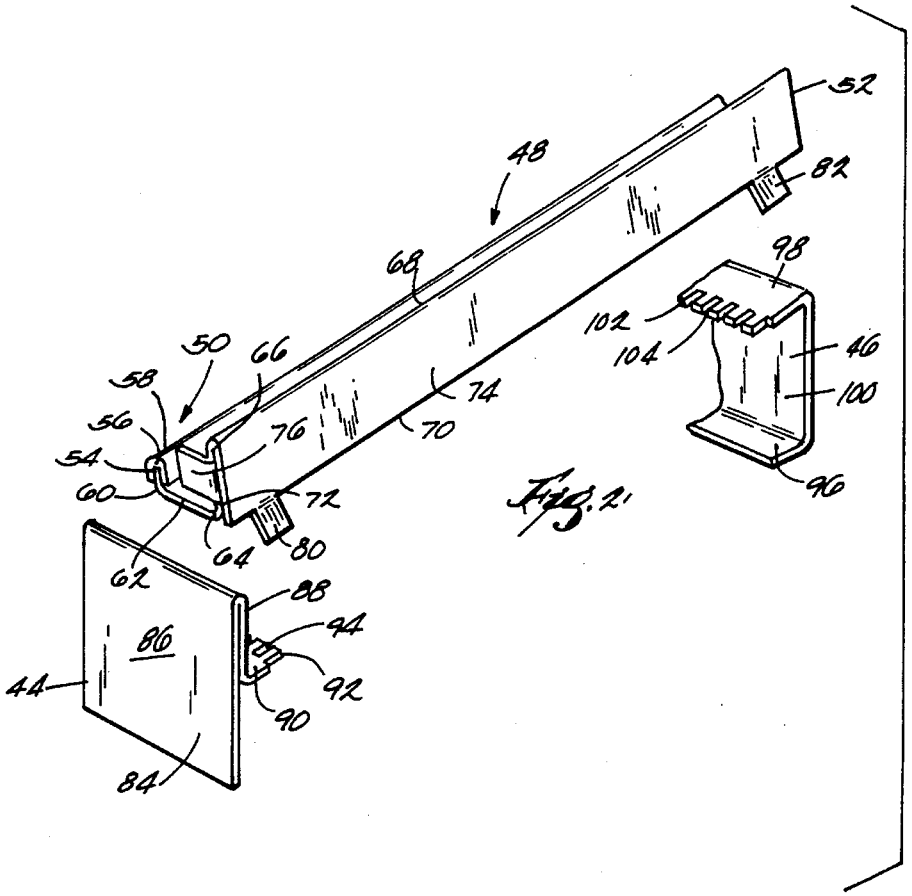
FIG. 2 is an exploded perspective view of a track and front and rear track supports.

Referring to FIG. 2, a track 48 having a front end 50 and a back end 52 is shown. Preferably, the track 48 is made from a single sheet of metal, stamped and formed. This is preferred as it provides an effective structural member at a reasonable fabrication cost as will become apparent as the description progresses. The track 48 includes a first leg 54 which extends from an edge 56. Preferably, the edge 56 has thereon a U-shaped liner 58, which as will be explained below, enhances the sliding action of the products along the track 48. Liner 58 can be made of any conventional low friction material such as, for example, silicon impregnated styrene. The first leg 54 extends downwardly to a right angle turn 60 and continues to form a web 62. Web 62 continues to a right angle turn 64 where a second leg 66, parallel to the first leg 54, is formed. The second leg 66 extends above the edge of first leg 56 and terminates in an upper edge 68 making the second leg 66 longer than first leg in that the first leg 54 terminates vertically below the second leg 66. At edge 68, the second leg 66 is turned 180° back on itself and extends downwardly and terminates in an edge 70 generally in the vicinity of web 62. The second leg 66 thus consists of a double walled member having an inner wall 72 and an outer wall 74. A flange 76 extends from and is integral with the inner wall 72 and is perpendicular with the longitudinal axis of the track 48. The flange 76 is located near the front end 50 of the track 48. A pair of tabs 80 and 82 extend downwardly from the outer wall 74 of the second leg 66, one at each end 50 and 52 of the track 48. The tabs 80 and 82 extend away from the web 62 in a direction opposite the direction of extension of the first and second legs 54 and 66 respectively. The location and purpose for the angled tabs 80 and 82 will be described more completely hereinafter.

Continuing to refer to FIG. 2, there is shown partial sections of the front track support 44 and the rear track support 46. The front track support 44 has a front panel 84 which provides a surface 86 for the display of indicia such as product information or advertising. A vertical wall 88 depends from the front panel 84. A front mounting plate 90 extends transversely from the vertical wall 88 and has an inner edge 92. Front mounting plate 90 is generally horizontal and has a plurality of spaced slots 94 formed within its inner edge 92. Preferably, front panel 84, vertical wall 88 and front mounting plate 90 are all part of a one-piece metal stamped and formed part.

As shown in FIG. 2, the rear track support 46 is generally U-shaped in cross-section and includes a wall 96, a rear mounting plate 98 and a web 100 connecting wall 96 to rear mounting plate 98. The rear mounting plate 98 is generally horizontal and has an inner edge 102. A plurality of spaced slots 104 are formed within the inner edge 102. Preferably, wall 96, web 100 and rear mounting plate 98 are all part of a one-piece metal stamped and formed part.

Referring back to FIG. 1, the spaced slots 94 (not shown) of the front mounting plate 90 and the spaced slots 104 of the rear mounting plate 98 are aligned and co-planar, and extend the length of the front and rear mounting plates 90 and 98. However, the rear track support 46 is raised slightly above front track support 44. Preferably, the rear track support 46 is 7°–11° from the horizontal higher than the front track support 44. This establishes the angle of the tracks 48 and which is directed generally downwardly toward the open front 14 of the housing 12.

Figure 3:
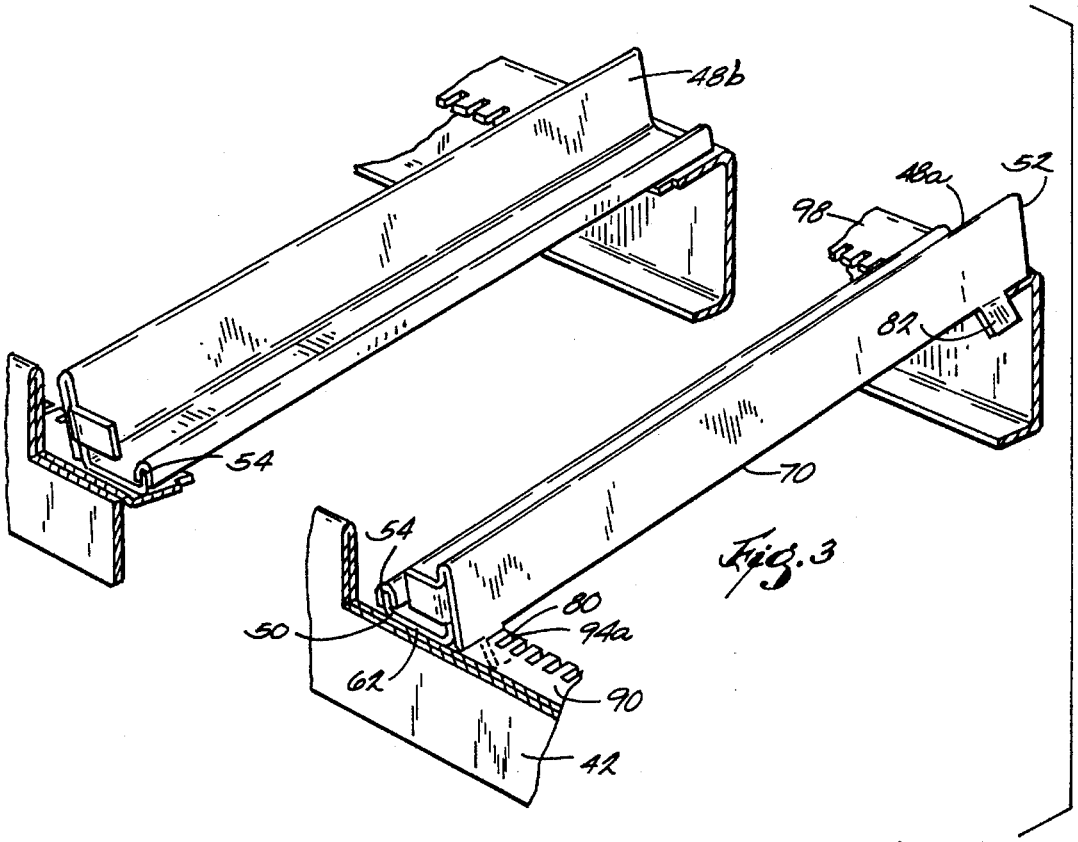
FIG. 3 is a perspective view of a pair of tracks supported by the front and rear track supports.

Referring now to FIG. 3, a pair of tracks 48 from which a row of products is dispensed is shown. The pair of tracks consists of two identical tracks **48*a* and 48*b*, one of which is rotated 180 degrees to be the mirror image of the other so that the first legs 54 of each track face each other. To assemble a pair of tracks 48*a* and 48*b* to accommodate a row of products, track 48*a* is set in place on the shelf 42 by aligning front tab 80 with a slot 94*a* of the front mounting plate 90 and aligning rear tab 82 with the corresponding and parallel slot 104*a* (not shown) on rear mounting plate 98. The tabs 80 and 82 are generally displaced from the vertical plane of outer wall 74 at this point so that they have an angular relationship to the outer wall 74. After the tabs 80 and 82 have been lowered into the respective slots 94*a* and 104*a*, the track 48*a* is rotated counterclockwise such that the web 62 engages and rests on the front and rear mounting plates 90 and 98 respectively. The tabs 80 and 82 anchor the track 48*a* in the desired position on the shelf 42. The angular orientation of the tabs 80 and 82 locks the track 48*a* in place vertically and thereby maintains the track 48*a* in a stable mounted position in the shelf 42 and with a minimum of material. That is, only tabs 80 and 82 are necessary at the opposite ends 50 and 52 of the track 48*a* and not a continuous extension co-extensive with the track 48*a* and extending below the point of edge 70. After the first track 48*a* is in place, the second track 48*b* (having the same construction as track 48*a*) of the pair of tracks is set into place on the shelf 42, as above, such that it is an appropriate distance away from the first track 48*a*** to accommodate the width of the product to be dispensed.

Figure 4:
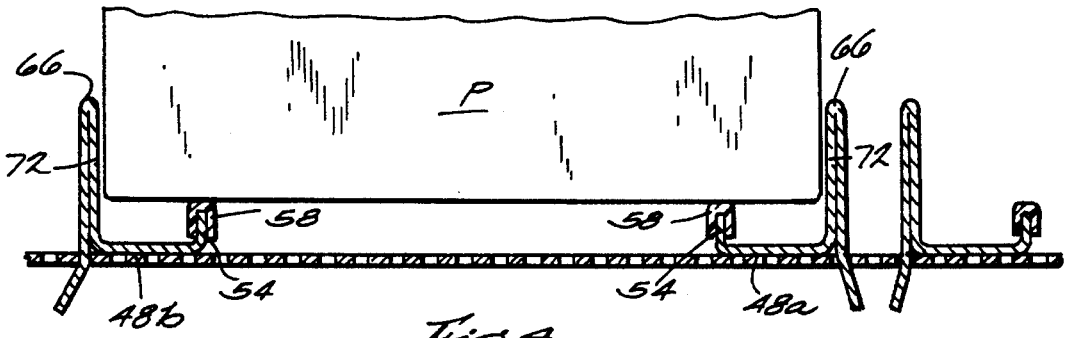
FIG. 4 is a cross-sectional view taken along line 4—4 of FIG. 1.

Referring to FIG. 4, there is shown a pair of tracks **48*a* and 48*b* in place on the shelf 42. The product P rests on the liner 58 of each first leg 54 of each track 48*a* and 48*b*. The inner wall 72 of each second leg 66 of each track 48*a* and 48*b*** acts as a guide for the product as it slides along the tracks.

With reference to FIG. 5, the open back 20 of the dispensing unit 10 is illustrated. The products to be dispensed are fed into the dispensing unit 10 from the open back 20. The products are placed on the liners 58 of each track **48*a* and 48*b* (not shown). As best shown in FIG. 1, due to the angle of the rear track supports 46 with respect to the front track supports 44, gravity in conjunction with low friction liner 58 on each track 48*a* and 48*b* forces the products toward the open front 14 of housing 12 until the first product loaded reaches the flange 76 of each track 48*a* and 48*b*. Later loaded products slide forward until they reach the previously loaded product. In this manner, the products are loaded from the back 20 of the dispensing unit 10** thereby insuring that the oldest product is the first to be dispensed.

In some applications, it may be possible to leave the back 20 of the housing 12 open the same as the front 14 of the housing 12. However, since many times the back 20 of the housing will be facing into an adjacent consumer aisle, it is desirable to provide a rear closure. In accordance with this invention, an effective closure is provided wherein the rear closure is a rear wall 106 which is in the nature of a gondola and it is connected to the housing 12 for movement toward and away from the housing 12 and also is capable of pivotal movement toward and away from the housing 12.

Referring again to FIG. 5, there is shown a plurality of dispensing units 10, 10' and 10". The rear wall 106' of dispensing unit 10' is in its closed position allowing for merchandising of other products (not shown). In this closed position, the rear wall 106 is generally co-extensive with the housing 12 and is spaced from the open front 14 of the housing 12 (FIG. 1). In contrast, the rear wall 106 of dispensing unit 10 is shown in its open position. Rear wall 106 has a rear panel 108, a step arrangement 110 and a plurality of suitable wheels or casters 112. An upper and lower hinge mechanism 114 and 116 connect the housing 12 to the rear wall 106 enabling movement of the rear wall 106 with respect to the housing 12. It should be noted that preferably the dispensing unit 10 utilizes two hinge mechanisms. However, a single hinge mechanism or more than two can be utilized. The upper and lower hinge mechanisms 114 and 116 are identical and only one will be described in detail hereinafter.

Figure 6:
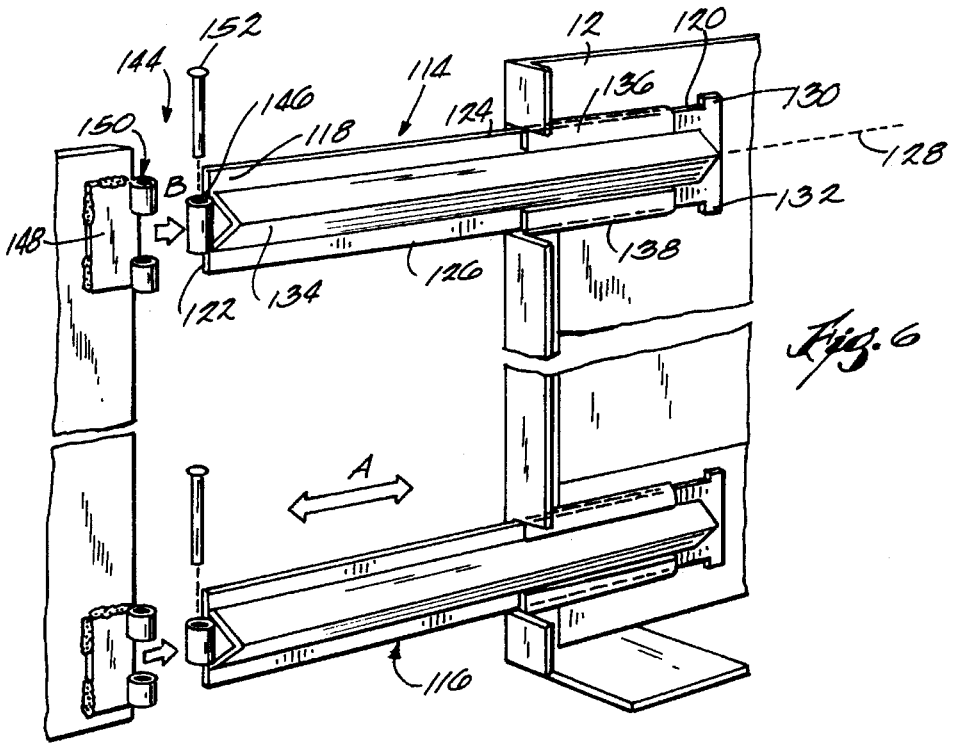
FIG. 6 is a perspective view of the hinge and pivot mechanisms of the dispensing unit.

Referring now to FIG. 6, the hinge mechanism 114 has a base member 118 having an inner end 120, an outer end 122, an upper edge 124 and a lower edge 126. The base member 118 is elongated, generally planar and has a longitudinal axis 128. Base member 118 is of generally uniform width from its outer end 122 to an area adjacent its inner end 120. Adjacent the inner end 120, the base member 118 is enlarged so as to be preferably T-shaped. Tabs 130 and 132 extend laterally from the base member 118 to form the T-shape and are in the same plane as the remainder of the base member 118. A triangular plate 134 is suitably affixed to the base member 118 to provide structural rigidity.

The hinge mechanism 114 has two U-shaped channel members 136 and 138 suitably attached to the housing 12 for example as by welding. Upper channel member 136 and lower channel member 138 are arranged so that their open ends face toward each other. The upper edge 124 of the base member 118 engages the upper channel member 136 while lower edge 126 of the base member 118 engages the lower channel member 138. This is a relatively snug fit yet the base member 118 is still capable of sliding movement within channel members 136 and 138. In this manner, the base member 118 can be moved in and out, as illustrated by Arrow A in FIG. 6, relative to the housing 12 and outward movement is limited by tabs 130 and 132.

Continuing to refer to FIG. 6, a pivot mechanism 144 is shown. Pivot mechanism 144 includes a connector 146 on the outer end 122 of the base member 118 and a plate 148 connected to rear panel 108 in any suitable manner such as by welding. Connector 146 and plate 148 interengage, as shown by Arrow B, to form a bore 150. A pin 152 fits through bore 150 to secure the connector 146 on the base member 118 to the plate 148 on the rear wall 106.

With this hinge and pivot mechanism arrangement, the rear wall 106, in gondola fashion, can be pulled directly away from the housing 12, and, after the rear wall 106 has cleared the step arrangement 110' of an adjacent dispensing unit 10', the rear wall 106 can then be pivoted as shown in FIG. 5 to provide access to the open back 20 of the housing 12 for loading products into the dispensing unit 10. When the loading is completed, rear wall 106 is pivoted and pushed back toward the housing 12.

What is claimed is:

1. A product dispensing unit comprising:

a housing having an open front and an open back;

vertically spaced shelves in said housing, exposed at said open front and extending rearwardly in said housing structure relative to said open front whereby products supported on said shelves are accessible through said open front;

a rear wall spaced from said open front and generally coextensive with said housing, said rear wall movable relative to said housing; and at least one hinge mechanism for selectively moving said rear wall relative to said housing to provide access to said open back of said housing, said hinge mechanism including two opposed U-shaped channel members fixed to said housing and opening toward each other, an elongated base member having first and second opposite edges, said first edge engaged in one of said channel members and said second edge engaged in the other of said channel members, said base member being movable in and relative to said channel members to move said rear wall toward and away from said housing, a plate connected to said rear wall, and a connector between said base member and said plate to permit said rear wall to pivotally move toward and away from said housing.

2. A product dispensing unit as set forth in claim 1 wherein said base member has an enlarged end formed by lateral projections on each of said first and second edges, said lateral projections generally aligned with each other, wherein said base member is of generally uniform width along the remainder of its length, wherein said base member terminates at a second end which is spaced from said enlarged end, and wherein said connector engages said base member at said second end.

3. A product dispensing unit as set forth in claim 1 wherein said at least one hinge mechanism is two hinge mechanisms spaced from one another.

4. A product dispensing unit as set forth in claim 1 wherein said rear wall includes at least one wheel.

5. A product dispensing unit comprising:

a housing having an open front and an open back, vertically spaced shelves in said housing exposed at said open front and extending rearwardly in said housing relative to said open front whereby products supported on said shelves are accessible through said open front, each of said shelves includes first and second track supports, said first track support mounted at said open front of said housing and said second track support mounted at said open back of said housing, each of said first and second track supports defining a plurality of horizontally spaced slots, each of said shelves including a plurality of elongated tracks extending between said open front and said open rear, said tracks having a front end and a back end, each of said tracks being generally U-shaped in cross-section in a plane parallel to said open front thereby defining two upwardly extending legs terminating in elongated edges extending between said open front and said open back of said housing, said tracks being arranged in pairs in said housing such that products are supported in said housing by said pair of tracks, and said tracks are inclined downwardly from said open back to said open front so that products slide along said pair of tracks via gravity toward said open front, wherein each of said tracks includes a pair of tabs extending from a point adjacent one of said legs and extending in a direction opposite to the direction of extension of said legs and at an angle relative to the vertical extension of said legs, one of said tabs is located near each of said ends of said track, said tabs extend below one of said slots in said respective track support and said leg adjacent said tab extending above said one of said slots to secure said track in said desired location in said housing;

a rear wall spaced from and generally coextensive with said housing; and a hinge and pivot mechanism attached to said housing and said rear wall for moving said rear wall toward and away from said open back of said housing and for moving said rear wall pivotally toward and away from said housing.

6. A product dispensing unit as set forth in claim 5 wherein said hinge and pivot mechanism includes two opposed U-shaped channel members fixed to said housing and opening toward each other, an elongated base member having first and second opposite edges, said first edge engaging one of said channel members and said second edge engaging the other of said channel members, said base member being movable in and relative to said channel members, a plate connected to said rear wall, and a connector between said base member and said plate.

7. A product dispensing unit as set forth in claim 5 wherein said first leg has a length that is shorter than said second leg in that said first leg terminates vertically below said second leg, and wherein each of said tracks includes a web portion extending between said first and second legs.

8. A product dispensing unit as set forth in claim 7 wherein each of said tracks includes an elongated liner covering said elongated edge of said first leg, said liner made of low friction material to enhance movement of products along said track toward said open front.

9. A dispensing unit as set forth in claim 5 wherein each of said tracks includes a flange projecting laterally from one of said legs toward the other of said legs and located adjacent said open front of said housing.

10. A dispensing unit as set forth in claim 5 wherein said tracks include a web portion extending between said first and second legs, each of said tracks is a formed member extending from the elongated edge of said first leg, along said first leg to a right angle bend at the junction of said first leg and said web, along said web portion to a right angle bend at the junction of said web portion and said second leg, along said second leg to a 180 degree bend that forms said elongated edge of said second leg, returning toward said web portion and terminating with said tabs below said web portion.

11. A product dispensing unit comprising:

a housing structure having an open front and an open back; and vertically spaced shelves in said housing structure, exposed at said open front and extending rearwardly in said housing structure relative to said open front whereby products supported on said shelves are accessible through said open front, each of said shelves includes first and second horizontally extending track supports, said first track support mounted at said open front of said housing structure and said second track support mounted at said open back of said housing structure, each of said first and second track supports having therein a plurality of horizontally spaced slots, wherein each of said shelves include a plurality of positionable elongated tracks extending between said open front and said open back, said tracks having a front end and a back end, said tracks being generally U-shaped in cross-section in a plane parallel to said open front thereby defining two upwardly extending legs terminating in elongated edges extending between said open front and said open back of said housing structure, said first leg is shorter than said second leg in that said first leg terminates vertically below said second leg, each of said tracks includes a web extending between said first and second legs to define said U-shape, wherein each of said tracks includes a tab portion extending from a point adjacent one of said legs and extending away from said web in a direction opposite to the direction of extension of said legs and at an angle relative to the vertical extension of said one leg, said tracks are positionable between said first and second track supports by placement of said tab portion in one of said slots in said first track support and in one of said slots in said second track support such that said legs extend above said slots and said tab portion extends below said slots, wherein said tracks are arranged in pairs in said housing structure such that said first legs of each of said pair of tracks are adjacent each other and such that products dispensed from said shelves are supported by each of said first legs of said pair of tracks, wherein said tracks are inclined downwardly from said open rear to said open front so that the products are fed by gravity from said open back to said open front of said housing.

12. A product dispensing unit as set forth in claim 11 wherein each of said tracks includes an elongated liner covering said elongated edge of said first leg of said track, said liner being made of a low friction material to enhance the movement of products along said tracks from said open back to said open front.

13. A product dispensing unit as set forth in claim 11 wherein said tracks include a flange projecting laterally from said second leg of said tracks toward said first leg and located adjacent said front end of said tracks.

14. A product dispensing unit as set forth in claim 11 wherein each of said tracks is a formed member extending from the elongated edge of said first leg, along said first leg to a right angle bend at the junction of said first leg and said web, along said web to a right angle bend at the junction of said web and said second leg, along said second leg to a 180 degree bend that forms said elongated edge of said second leg, returning toward said web and terminating with said tabs below said web.

15. A product dispensing apparatus comprising:

a housing having a front and a back; and vertically spaced shelves in said housing, exposed at said front and extending rearwardly in said housing relative to said front whereby products supported on said shelves are accessible through said front, each of said shelves including front and back track supports, said back track support mounted in spaced relation from said front track support toward said back of said housing, each of said front and back track supports defining a plurality of spaced slots, and wherein said back track support is elevated with respect to said front track support with respect to a horizontal plane, wherein each of said shelves includes a plurality of elongated tracks extending between said front and said back, said tracks having an upwardly extending leg terminating in an elongated edge extending between said front and said back of said housing, each of said tracks having a base portion extending laterally from said leg, wherein each of said tracks includes a tab portion disposed at an angle to both said leg and said base and projecting through a selected one of said slots.

* * * * *